US005869224A

United States Patent [19]

Mitzinger

[11] Patent Number: 5,869,224

[45] Date of Patent: Feb. 9, 1999

[54] PROCESSING OF REVERSAL MATERIALS

[75] Inventor: Herbert Mitzinger, Lindlar-Remshagen, Germany

[73] Assignee: Agfa Gevaert Aktiengesellschaft, Leverkusen, Germany

[21] Appl. No.: 59,983

[22] Filed: May 12, 1993

[30] Foreign Application Priority Data

May 22, 1992 [DE] Germany ..... 42 17 022.2

[51] Int. Cl.[6] ..... G03C 5/50; G03C 7/46; G03C 5/18; G03C 5/26

[52] U.S. Cl. ..... 430/407; 430/372; 430/379; 430/399; 430/403; 430/428; 430/441

[58] Field of Search ..... 430/372, 379, 430/399, 403, 407, 428

[56] References Cited

U.S. PATENT DOCUMENTS

| | | | |
|---|---|---|---|
| 4,752,556 | 6/1988 | Kishimoto | 430/372 |
| 4,804,616 | 2/1989 | Ueda et al. | 430/407 |
| 4,948,711 | 8/1990 | Kojima et al. | 430/455 |
| 5,110,715 | 5/1992 | Werniche et al. | 430/407 |
| 5,529,890 | 6/1996 | McGuckin et al. | 430/372 |
| 5,578,432 | 11/1996 | McGuckin et al. | 430/372 |

FOREIGN PATENT DOCUMENTS 63-249 847 10/1988 Japan .

OTHER PUBLICATIONS

Communication of Eastman Kodak to processing laboratories, Dec. 1985, section entitled "Entwicklungsprozess E–6" (pp. 24–28 and 46).

*Primary Examiner*—Mark L. Bell
*Assistant Examiner*—J. Pasterczyk
*Attorney, Agent, or Firm*—Connolly and Hutz

[57] ABSTRACT

In reversal processing, washing between the first development and the reversal bath can be avoided without any loss of photographic quality if the reversal bath is operated in countercurrent over at least two stages and hydroquinone sulfonic acid is used as the first developer.

2 Claims, No Drawings

PROCESSING OF REVERSAL MATERIALS

Color reversal films are processed worldwide by a standardized process, the E6 process, which comprises the following steps: first development, first wash, reversal bath, color development, conditioning bath, bleaching bath, fixing bath, final wash, stabilizing bath, drying (communication of Eastman Kodak to processing laboratories, December 1985).

Hydroquinone sulfonic acid is used as the first developer at a pH value of 9.7. The reversal bath, which makes unexposed silver halide developable, contains at least one tin(II) complex which is used at around pH 5.8. The color developer is used with the color developer compound CD 3 at pH 12.1.

The object of the first wash is to interrupt the chemical reactions after the first development time and to prevent first developer from being carried over into the reversal bath. Inadequate washing, incorrect water temperatures (temperatures of 33° to 39° C. are recommended) or excessively long washing times (times of 1 to 4 minutes are recommended) can cause changes in density (sensitivity utilization) and color shifts. The importance of the first wash is reflected in the fact that 7.5 liters fresh water have to be used per minute.

Unless washing is sufficiently thorough, an increase in the pH value of the reversal bath can be expected, resulting in faster ageing of this bath through oxidation, and the silver halide can be expected to undergo reduction to silver although only fog nuclei are supposed to be formed, which results in the unwanted photographic effects mentioned above.

On the other hand, the large quantity of washing water presents ecological problems and causes considerable costs through the need for disposal.

The problem addressed by the present invention was to provide an improvement without any deterioration in the photographic results.

It has now surprisingly been found that the need for washing can be substantially eliminated providing the following reversal bath is used in a countercurrent cascade comprising at least 2 stages and preferably 2 to 4 stages.

Accordingly, the present invention relates to a method for processing photographic reversal silver halide materials comprising the following steps: (a) first development, (b) reversal, (c) color development, (d) conditioning, (e) bleaching, (f) fixing, (g) washing, (h) stabilization and (i) drying, characterized in that virtually no washing takes place between steps (a) and (b) and step (b) is carried out in countercurrent over at least 2 stages.

Virtually no washing between steps (a) and (b) means that washing with considerably smaller quantities of water than the recommended 7.5 l/minute is not ruled out, although washing between steps (a) and (b) is preferably dispensed with altogether.

In another advantageous embodiment, the recommended quantity of refill solution for the reversal bath is not increased. 1100 ml/m$^2$ reversal material are recommended. In addition, the composition of the reversal bath is not changed either.

However, the reversal bath may be adapted to the modified procedure in the pH value and in the dilution factor of the concentrate and to the carryover rate.

In another advantageous embodiment, the final wash, for which 7.5 l water/minute is also recommended in the standard process, is also dispensed with and the stabilizing bath is operated in countercurrent over at least two stages and preferably 3 to 5 stages. The recommended quantity of refill solution for the stabilizing bath of 1100 ml/m$^2$ is preferably not exceeded. The composition of the stabilizing bath also remains unchanged.

Accordingly, commercially available reversal and stabilizing baths and all other necessary baths may be used without modification in the process according to the invention.

EXAMPLE 1

(Comparison)

Three commercially available reversal films

Agfachrome 100 RS

Ektachrome Plus 100

Fujichrome RDP 100 were each exposed with a grey step wedge and developed in accordance with the E6 specification. The values shown in the following Table were obtained.

EXAMPLE 2

(Invention)

The same films as in Example 1 were developed by the method according to the invention, i.e. without washing after the first developer and with a two-stage reversal bath countercurrent cascade, the other process data corresponding to the standard process.

The sensitometric values shown in the following Table were obtained.

EXAMPLE 3

(Invention)

The regeneration rate of the reversal bath was 1.1 l/m$^2$; the carryover of developer into the reversal bath was 70 ml/m$^2$.

Accordingly, in its in-use state, the reversal bath contains 64 ml first developer/l in the first stage and 4.5 ml first developer/l in the second stage.

In stages 1 and 2, these baths were used under otherwise the same conditions as in Example 2.

The sensitometric values shown in the following Table were obtained.

In the following Table:

Gamma 0=gradation slope between 0.1 log I.t over fog and 5 log I.t

Gamma 1=gradation slope between 5 log I.t and 10 log I.t

Gamma 2=gradation slope between 10 log I.t and 15 log I.t

D max.=maximum density

D min.=fog

The densities for yellow, magenta and cyan are shown from the left.

It can be seen from the Table that, in all the Examples, only slight deviations which are largely within the limit of error were observed for the three commercially available reversal films used.

| Example | Gamma 0 | | | Gamma 1 | | | Gamma 2 | | | D max. | | | D min. | | |
|---|---|---|---|---|---|---|---|---|---|---|---|---|---|---|---|
| AGFA | | | | | | | | | | | | | | | |
| 1 | 114 | 112 | 110 | 201 | 181 | 179 | 238 | 249 | 228 | 355 | 350 | 314 | 20 | 19 | 15 |
| 2 | 113 | 110 | 107 | 197 | 174 | 172 | 238 | 254 | 235 | 356 | 357 | 322 | 17 | 16 | 13 |
| 3 | 112 | 106 | 102 | 197 | 169 | 165 | 237 | 253 | 237 | 359 | 360 | 324 | 23 | 21 | 17 |
| Kodak | | | | | | | | | | | | | | | |
| 1 | 74 | 81 | 69 | 159 | 161 | 134 | 242 | 237 | 193 | 341 | 332 | 299 | 17 | 20 | 17 |
| 2 | 72 | 80 | 69 | 151 | 158 | 134 | 239 | 239 | 195 | 344 | 337 | 306 | 17 | 20 | 17 |
| 3 | 77 | 83 | 69 | 159 | 164 | 137 | 242 | 244 | 197 | 349 | 342 | 308 | 18 | 21 | 17 |
| Fuji | | | | | | | | | | | | | | | |
| 1 | 88 | 100 | 72 | 167 | 164 | 144 | 220 | 217 | 199 | 347 | 344 | 303 | 18 | 18 | 16 |
| 2 | 85 | 96 | 62 | 171 | 169 | 141 | 225 | 215 | 191 | 362 | 352 | 311 | 19 | 19 | 17 |
| 3 | 82 | 87 | 53 | 171 | 166 | 133 | 216 | 207 | 185 | 361 | 355 | 320 | 21 | 20 | 18 |

A–G 5825 - Foreign Countries

I claim:

1. A method for processing exposed color photographic reversal silver halide materials comprising the following steps: (a) first development, (b) reversal bath, (c) color development, (d) conditioning, (e) bleaching, (f) fixing, (g) washing, (h) stabilization and (i) drying, characterized in that hydroquinone sulfonic acid is used as the first developer, and no washing takes place between steps (a) and (b) and step (b) is carried out in countercurrent over at least 2 stages.

2. A method as claimed in claim 1, characterized in that washing (g) is avoided and step (h) is carried out in countercurrent over at least two stages.

* * * * *